US005891302A

United States Patent [19]

Marschke

[11] Patent Number: 5,891,302

[45] **Date of Patent: *Apr. 6, 1999**

[54] HEATING MODULE FOR UPPER WEB SURFACE IN A DOUBLE BACKER

[75] Inventor: Carl R. Marschke, Phillips, Wis.

[73] Assignee: Marquip, Inc., Phillips, Wis.

[ * ] Notice: The term of this patent shall not extend beyond the expiration date of Pat. No. 5,561,918.

[21] Appl. No.: 697,768

[22] Filed: Aug. 29, 1996

[51] Int. Cl.[6] ..... B30B 15/34; F26B 13/00

[52] U.S. Cl. ..... 156/583.3; 156/470; 156/583.8

[58] Field of Search ..... 156/470, 471, 156/492, 583.3, 583.8, 583.91, 583.5; 100/92, 309; 165/46

[56] References Cited

U.S. PATENT DOCUMENTS

| | | | |
|---|---|---|---|
| 690,713 | 1/1902 | Ferres | 156/471 |
| 3,216,493 | 11/1965 | Maginn | 165/46 |
| 3,779,843 | 12/1973 | Knapp | 156/62.2 |
| 4,164,253 | 8/1979 | Skala . | |
| 4,935,082 | 6/1990 | Bennett et al. | 156/470 |
| 5,256,240 | 10/1993 | Shortt | 156/470 |
| 5,561,918 | 10/1996 | Marschke | 156/470 |

FOREIGN PATENT DOCUMENTS

| | | |
|---|---|---|
| 0 077 186 | 7/1982 | European Pat. Off. . |
| 0 130 718 | 6/1984 | European Pat. Off. . |
| 0 485 731 | 4/1991 | European Pat. Off. . |
| 1359232 | 3/1963 | France . |
| 1467850 | 12/1965 | France . |
| 1106024 | 5/1966 | United Kingdom . |
| 1161990 | 9/1966 | United Kingdom . |
| 1179908 | 5/1967 | United Kingdom . |

OTHER PUBLICATIONS

Patent Abstracts of Japan, English Language Abstract of JP 56–057885.

*Primary Examiner*—Richard Crispino
*Attorney, Agent, or Firm*—Andrus, Sceales, Starke & Sawall

[57] ABSTRACT

An apparatus for curing the web bonding adhesive and drying the corrugated paperboard web utilizes a top heating module contacting the upper face surface of the paperboard web for simultaneously heating the paperboard web along with a series of lower heating units. The top heating module includes of a series of internal heating elements. The heating elements are preferably tubes which receive a supply heated gas or liquid and transfer the heat contained therein to a heat exchange fluid within the module. The heat from the heat exchange fluid is then transferred to the paperboard web through a web-conforming contact member. As the paperboard passes through the double backer, the combination of the top heating module and the lower heating units cure the adhesive bonds in the paperboard web. The web-conforming contact member preferably comprises a thin metal membrane and the heat exchange fluid is a liquid. Heat transfer and uniform contact is achieved by hydrostatic pressure of the liquid acting through the membrane against the web.

14 Claims, 3 Drawing Sheets

HEATING MODULE FOR UPPER WEB SURFACE IN A DOUBLE BACKER

BACKGROUND OF THE INVENTION

The present invention pertains to the production of a laminated web, such as corrugated paperboard and, more particularly, to a double backer in which a pre-heating element is used in conjunction with a standard heating element to form the adhesive bonds in the paperboard web.

In a typical prior art double backer, a liner web is brought into contact with the glued flute tips of a single face corrugated web, and the freshly glued double face web is then passed over the surfaces of a number of serially arranged heating units, usually steam chests, to cause the starch-based glue to set and to drive moisture from the web. Double face web travel over flat heated surfaces of steam chests is typically provided by a wide driven holddown belt in direct contact with the upper face of corrugated web. The top face of the belt, in turn, is held in contact with the traveling web by any of several types of weight or force applying devices, well known in prior art. For example, the holddown belt may be engaged by a series of weighted ballast rollers, it may be forced into contact with the web by air pressure from a system of nozzles located over the web, or an arrangement of inflatable air bladders may be operated to press the moving holddown belt into contact with the double face web. It is also known to provide means for varying the ballast load applied to the holddown belt and web, both longitudinally in the machine direction and laterally in the cross machine direction.

The use of a driven holddown belt in a double backer has a number of attendant disadvantages. The holddown belt must be mounted for continuous travel in the manner of the conventional continuous conveyor belt system and, therefore, must also include a separate belt drive means. The holddown belt also must necessarily overlie the entire surface of corrugated web, at least in the heating section, and, as a result, may inhibit the escape of moisture from the board as it dries. Also, the edges of the belt which overhang the edges of the corrugated web run in contact with surfaces of the steam chests or other heating surfaces and are subject to wear.

In a commonly owned, co-pending patent application Ser. No. 08/643,627, a double backer is provided in which the driven holddown belt is eliminated. Stationary holddown strips, extending parallel to one another in the direction of web movement, are supported from above to contact the entire web across its width and along the heating section. A separate downstream vacuum conveyor is used to pull the corrugated web through the heating section.

The double backer, as previously described, applies heat through the use of the serially arranged heating units only to the bottom side of the web as it is being constructed. While applying heat to only one side is sufficient in most cases, it has been found that the heat transfer from the single sided heating units is often insufficient to cure the additional glue bonds when the double backer is running heavy weight double or triple wall board. For instance, when running triple wall board, which consists of three layers of single face web bonded together with an outer liner, the heat from a conventional lower heating unit raises the temperature of the starch close to the heating units, gelling the starch and flashing the excess water to steam. The steam then migrates through the wall board, heating the more remote glue lines. Although this system is sufficient to cure the bonds between the lower outer liner and its adjacent fluted medium layer, the conventional lower heating units do not transmit sufficient heat to the more remote bonds which can cause problems to occur, including inadequate bonding and insufficient drying. To solve this problem, the double backer, and thus the entire corrugator, must be slowed considerably to allow for adequate heating.

SUMMARY OF THE INVENTION

In accordance with the present invention, a double backer is provided in which an additional heating unit is supplied such that the double backer can simultaneously heat both sides of the double face web. The additional heating unit, positioned on the opposite side of the web from the series of conventional heating units, is positioned upstream from the web holddown assembly. The upper heating module acts to apply heat and downward force on the opposite surface of the web to provide supplemental heating to the face of the web opposite the conventional lower heating units when running heavyweight double or triple wall board.

The apparatus of the invention includes a top heating module mounted to contact the paperboard web traveling through the double backer at an upstream portion of the heating section. The top heating module contacts the upper face surface of the paperboard web while the conventional lower heating section contacts the lower face surface of the heating web such that the combination of the top heating module and the lower heating units simultaneously heat both face surfaces of the paperboard web.

The top heating module is preferably connected to an adjustment means by a hinge mechanism. The adjustment means allows for movement of the top heating module toward and away from the paperboard web traveling through the double backer. The hinge mechanism between the adjustment means and the top heating module allows the top heating module to form a part of the holddown mechanism positioned downstream from the top heating module.

The top heating module includes a series of heating tubes which are connected to form a serpentine path which preferably extends laterally with respect to the direction of paperboard web travel. The top heating module contains a cover, a lower contact plate and a supply of heat exchange fluid. The heat exchange fluid is contained among a series of heating tubes, such that the heat from the heating tubes is transferred to the heat exchange fluid, which then transfers the heat through the lower contact plate to the paperboard web.

In one embodiment of the invention, the holddown mechanism is a series of metal strips which extend parallel to the direction of paperboard web travel and are connected between the downstream end of the top heating module and a downstream support. As the downstream support connected to the holddown strips is raised or lowered, the length of the holddown strips contacting the top face surface of the paperboard web increases, thereby increasing the holddown force.

In a further embodiment, the top heating module can be connected to an adjustment means which moves the top heating module in a direction perpendicular to the upper face surface of the paperboard web. In a further embodiment for use with a double backer, a holddown belt is used in connection with the top heating module to provide the required holddown force between the paperboard web and the lower heating units. In this embodiment, the combined length of the top heating module and the holddown belt may be approximately equal to the length of the heating section and the cooling section immediately downstream from the heating section in the double backer.

DETAILED DESCRIPTION OF THE PREFERRED EMBODIMENTS

Figure 1:
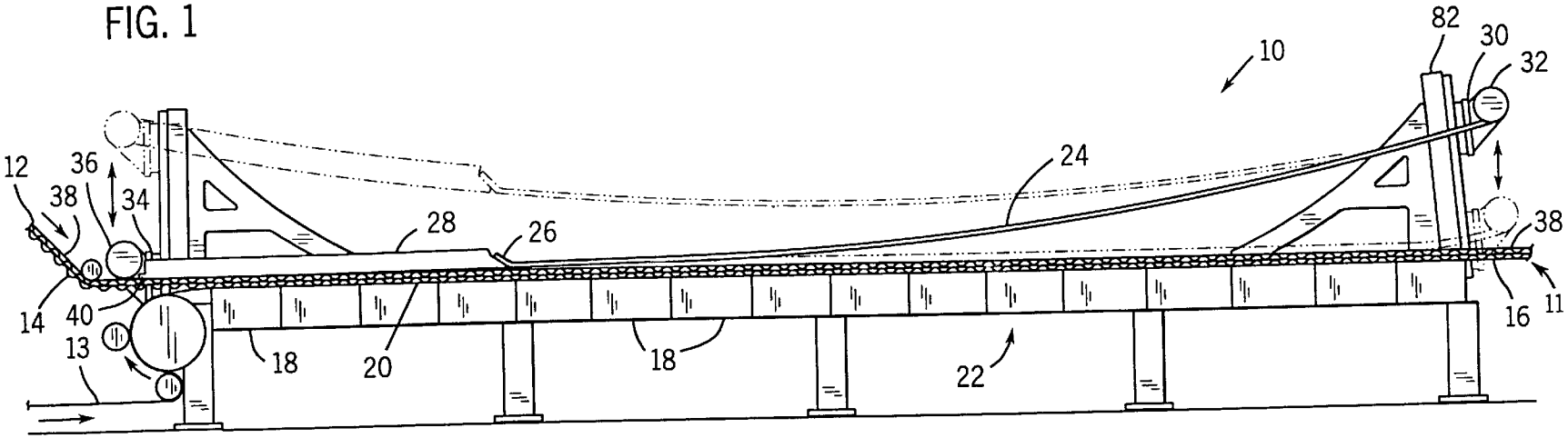
FIG. 1 is a side elevation of a double backer incorporating the presently preferred embodiment of the present invention.

Referring initially to FIG. 1, there is shown in generally schematic form a double backer 10 of the presently preferred embodiment of the invention. In the double backer 10, a double face corrugated web 11 is formed by joining a corrugated web 12 such as the two single face webs shown in FIG. 1, or a triple wall web (FIG. 4), and a liner web 13. The glue tips of both corrugated media 14 of the corrugated web 12 are covered with a starch-based adhesive in a series of upstream glue machines (not shown) and the adhesive bonds between the glue tips of the single face liners, and the liner 13 are cured by the application of heat and pressure in the double backer 10.

Heat is supplied to the lower surface 16 of the double face corrugated web 11 by a series of heating units 18 having flat, coplanar heating surfaces 20 over which the web 11 travels through the double backer 10. The heating units 18 typically comprise individual steam chests which are fabricated of a heavy-walled cast iron or steel construction, but may as well comprise any suitable flat heated surface. Each steam chest has an open interior to which high pressure steam is supplied in a known manner and utilizing a supply system which is not shown in the drawings. Each heating unit 18 may be 18 to 24 inches in length (in the direction of web movement) and have a width in the cross machine direction sufficient to fully support the maximum width of corrugated web 11 to be processed, e.g. 96 inches. The total length of the heating section 22 provided by a series of heating units 18 may be, for example, 40 feet.

In the embodiment shown in FIG. 1, a series of flexible parallel metal strips 24 are suspended above the heating section 22 in a manner such that the sag or catenary in the strips 24 allows them to lie atop the corrugated web 11 and provide the holddown force necessary to facilitate uniform heating and drying of the web 11 and curing of the adhesive. The strips 24 may, for example, be made of stainless steel with a width of about 3 inches and a thickness of about 0.030 inch. A sufficient number of strips 24 must be utilized to provide an overall holddown width in the cross machine direction sufficient to cover the full width of web 11 being processed. Ballast or load plates are preferably attached to the tops of the strips 24, as disclosed in the above identified copending patent application. The strips 24 are preferably mounted to be quite closely spaced so that with 3 inch wide strips 24, they may be mounted on 3⅛ inch centers. The upstream ends 26 of the strips are attached to the downstream end of the top heating module 28 and the downstream ends 30 are attached to a common downstream support 32. Although the invention has been described as having the series of strips 24 to provide the required holddown force, alternate methods of providing the holddown force, such as a conventional driven holddown belt could also be used.

In the embodiment shown in FIG. 1, the upstream end 34 of a heating module 28 is connected to an upstream support 36 which is positioned just upstream of the upstream-most heating unit 18 just above the incoming single face and liner webs 12 and 13. The downstream support 32 may be positioned a greater distance downstream of the downstream-most heating unit 18. Either or both of the supports 32 and 36 may be mounted for adjustable vertical movement as indicated by the arrows in FIG. 1. By raising one or both of the supports 32 and 36, the respective upstream and downstream ends of the strips 24 may be raised to vary the length of the strips resting upon and in contact with the double face web 11. Additionally, vertical movement of the upstream support 36 raises or lowers the top heating module 28 to apply heat and holddown force to the web 11, or remove the top heating module 28, as is shown in phantom and will be discussed in further detail below.

As can be seen in FIG. 1, when the upstream support 36 is moved completely downward towards the moving web 11, the top heating module 28 contacts the top face surface 38 of the paperboard web 11.

Figure 2:
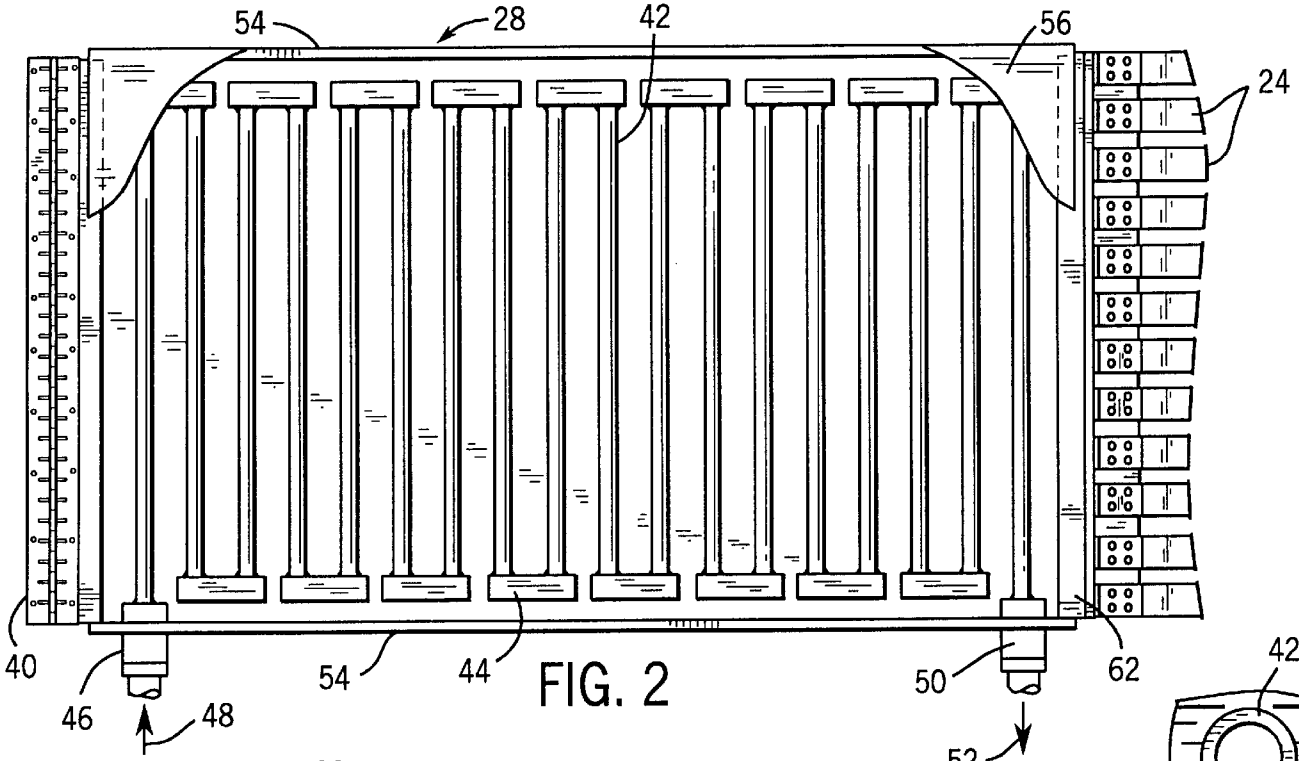
FIG. 2 is a partial sectional top view of the top heating module of the present invention.

Referring to FIGS. 1 and 2, it can be seen that the heating module 28 is connected to the upstream support 36 by a hinge mechanism 40 in the presently preferred embodiment of the invention. The hinge mechanism 40 allows the heating module 28 to rotate about a fixed point as the upstream support 36 is raised away from the web 11. Additionally, the hinge mechanism 40 allows the top heating module 28 to lie flat against the upper face surface 38 of the paperboard web 11 when the upstream support 36 is lowered.

Referring to FIG. 2, the top heating module 28 contains a series of heating tubes 42 which extend laterally with respect to the direction of paperboard web travel. Each of the heating tubes 42 is connected by an end portion 44 which provides communication between a pair of adjacent heating tubes 42 to form a serpentine structure. Alternately, the heating tubes 42 could be arranged in parallel with a common header on each end of the tube with the tubes oriented either laterally or in the machine direction. Heating elements other than steam supply tubes may also be used. For example, electric resistance heating elements could be provided. In the preferred embodiment of the invention, the heating tubes 42 are constructed to carry a supply of steam, which enters the heating tubes through a steam inlet 46 as shown by the arrow 48. Heated steam travels through the series of heating tubes 42 and end portions 44 and exits through the condensation outlet 50, as shown by the arrows 52. The amount of heat applied by the top heating module 28 can be controlled by varying the amount or temperature of steam introduced into the heating tubes 42.

Figure 3:
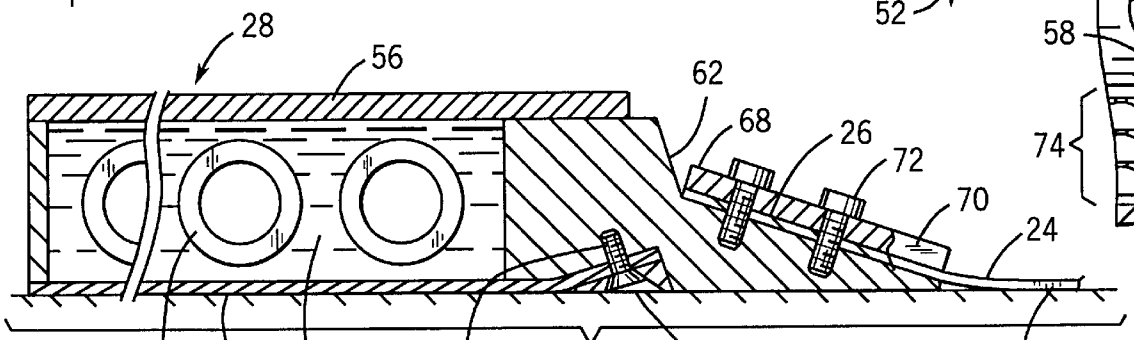
FIG. 3 is an enlarged sectional detail of a portion of the heating module shown in FIG. 2.

As can be seen in FIGS. 2 and 3, the top heating module 28 is a flat, box-like housing defined by a pair of side walls 54, an upper cover 56 and a lower contact membrane 58. The top heating module 28 has a width in the cross machine direction sufficient to fully contact the maximum width of corrugated web 11. In the preferred embodiment, the top heating module 28 may have a total length of approximately 12 feet. In the preferred embodiment of the invention, the cover 56 is constructed to fit the particular embodiment, as will be discussed, while the lower contact membrane 58 is preferably constructed of 0.018 inch stainless steel. The thickness of the contact membrane 58 is important since the contact plate 58 contacts the upper face surface 38 of the paperboard web 11 and transfers the heat to the paperboard web and must be flexible to provide uniform force on the web. The type of cover 56 used, if any, will depend upon the nature of the heat transfer medium being utilized, as will be described, and also the manner in which the module is moved vertically to place it in operative contact with the web and to lift it therefrom to an inoperative position. For example, if the module is maintained substantially horizontal during vertical movement in both directions, then a sealed cover 58 may not be needed to adequately contain a liquid heat transfer medium. However, if the hinge mechanism 40 is utilized and the module is subject to tilting during movement, a completely sealed cover 56 may be needed to prevent spilling or leaking of ballast liquid. Also, if it is desired to utilize the heating module 28 in a manner in which the entire weight of the module is placed on the web (such that the module "floats" thereon), it may be desirable to minimize the weight of the box-like module housing, including the cover 56.

To effectively transfer the heat from the steam to the upper face surface 38 of the paperboard web 11, a heat exchange fluid 60 is contained within the housing of the top heating module 28, as shown in FIG. 3. The heat exchange fluid 60 fills the housing between the serpentine structure of individual heating tubes 42, or other system of heating elements, and absorbs heat from the steam contained within the tubes. In one embodiment of the invention, the heat exchange fluid 60 is oil, although equivalent liquids having similar characteristics with regard to specific heat, ease of handling and absolute safety in case of leaks could be used. Additionally, the heat exchange fluid 60 could be a low melting point solid, such as equal parts lead, tin and bismuth which melts at 258° F. The use of a heat exchange fluid 60 provides the additional benefit of increasing the weight of the top heating module 28, which, when lowered, provides a downward force on the web 11. More significantly, a liquid heat transfer medium provides uniform contact and uniform force per unit area of the top heating module 28 on the web. In other words, the liquid medium, acting through the thin stainless steel contact membrane 58, provides a hydrostatic pressure which creates a uniform pressure and uniform holddown force.

Referring again to FIG. 1, it can be seen that the top heating module 28 overlays a portion of the series of heating units 18, such that the heating units 18 and the top heating module 28 apply heat to the paperboard web 11 simultaneously at an upstream portion of the double backer 10.

Referring back to FIG. 3, the upstream end 26 of each flexible parallel metal strip 24 is connected to the downstream end of the top heating module 28 by a mounting member 62. The mounting member 62 is securely fixed to top heating module 28 by a screw 64 which passes through the lower contact membrane 58 and engages an internal bore 66 in the mounting member 62. The mounting member 62 has a sloping surface 68 which is used to affix the upstream end 26 of the metal strips 24 to the mounting member 62 through the use of a holddown plate 70 and a series of bolts 72. As can be seen in FIG. 2, a total of four bolts 72 are used to secure each strip 24 to the mounting member 62. As can be understood in FIG. 1, when the upstream support 36 is lowered, a larger portion of the strips 24 contact the top surface 38 of the paperboard web 11 to provide a holddown force between the paperboard web and the series of heating units 18.

Figure 4:
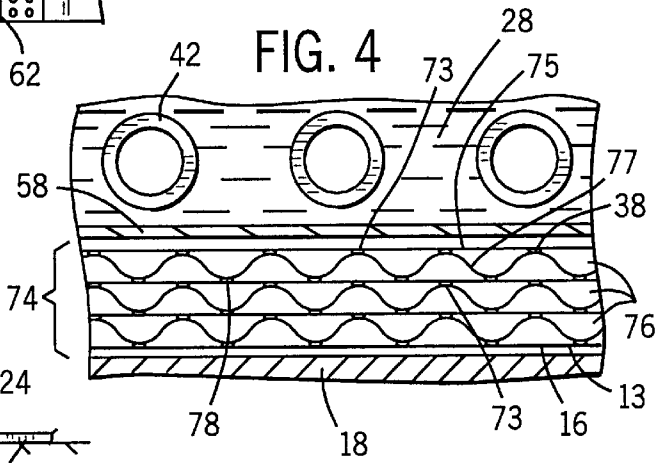
FIG. 4 is an enlarged sectional detail showing a portion of the top heating module and a portion of the paperboard web.

Shown in FIG. 4 is an example of a triple wall paperboard web 74 which consists of three layers of single face web 76 bonded together with an outer liner 13. Each of the three single face webs 76 will have been made in an upstream single facer in which the glue joints or glue lines 73 between the flute tips of the corrugated medium 77 and the liner web 75 will have been partially cured. However, as each of the single face webs 76 is brought into the double backer, an upstream glue machine will apply fresh adhesive to the exposed flute tips on the single face web. These glue lines 78 are brought into contact with the liner web 75 of the next single face web, or in the case of the lowermost single face web 76, the lowermost liner 13. In any event, it will be appreciated that the glue lines or glue bonds 73 formed in the single facer will have been at least partially cured at that time, but the fresh glue lines 78 are virtually uncured coming into the double backer. The web structure shown in FIG. 4 has an upper face surface 38 (the outer face of liner web 77) and a lower face surface 16 (the outer face of liner web 13) much like the double wall board previously discussed. As the triple wall board 74 passes into the double backer 10 shown in FIG. 1, the top heating module 28 supplies heat to the upper face surface 38 to help complete the curing of the single face bonds 73 in the web and to begin curing the bonds 78 between adjoining single face webs 76. The conventional heating units 18 also help complete or begin curing the bonds in the lower portions of the triple wall board closer to the lower face surface 16 in the same manner. Therefore, the double backer can be operated at higher speeds when running triple wall or thick double wall paperboard.

In operation, the heating tubes 42 heat the heat exchange fluid 60, and thus the contact member 58, to a temperature of about 380 degrees F. That heat is applied to the upper face surface 38 of the web 11, along with the uniformly distributed force provided by the weight of the top heating module 28, if the module is constructed to float on the web as discussed above. The heat acts to complete the curing of the adhesive joining the single face web components, begins curing the freshly glued flute tips, and quickly flashes the remaining water in the adhesive to steam, which penetrates into the cavities between the flutes to heat the interior adhesive lines. In this manner, all of the adhesive joints are cured, while also drying the board.

Although the present invention has been described as shown in FIG. 1, in an alternate embodiment the top heating module 28 could be securely connected to a movable mechanism to move the top heating module 28 vertically and generally perpendicular to the paperboard web rather than being connected to the upstream support 36 via the hinge mechanism 40. In the completely down position, the top heating module 28 is lowered onto fixed stops to limit downward travel and define the vertical position of the module 28 itself. The lower flexible contact membrane 58 is positioned level with the board upper surface 38 and permits uniform transmission of a downward force on the web 11 equal to the hydrostatic pressure exerted by the heat exchanger fluid 60. The force provided by the hydrostatic pressure insures even and uniform application of heat and pressure to the web 11. It is important to note that the hydrostatic pressure provided through the thin lower contact plate 58 of the heating module not only conforms the heating module uniformly to the upper face surface 38 of the web, but also uniformly presses the lower face surface 16 of the web into intimate contact with the heating units 18.

In an additional alternate embodiment of the invention, the top heating module 28 could be connected to an adjusting means which adjusts its height with respect to the paperboard web traveling over the conventional heating units. Located downstream from the top heating module 28 would be a conventional holddown belt (not shown). The combination of the top heating module 28 and the holddown belt would run substantially the entire length of the series of heating units 18 and traction section downstream thereof. The conventional holddown belt would effect movement of the paperboard web 11 through the double backer 10, while the top heating module 28 and the heating elements 18 at the upstream end of the double backer could simultaneously apply heat to both face surfaces of the paperboard web to form the bonds to hold the web together.

Referring again to FIG. 1, with both pairs of upstream and downstream end supports 32 and 36 moved to their lowermost position, the holddown strips 24 overlie a large portion of the heating units 18 in the double backer 10, while the top heating module 28 contacts the upper face surface 38 of the paperboard web 11. If it is desired to reduce the amount of heat transferred to the corrugated web traveling between the heating units 18 and the holddown strips 24, the downstream end support 32 is driven upwardly along the support frame 82 to carry the downstream support 32 and the attached holddown strips 24 vertically upward. This results in an increasing length of the holddown strips 24 being lifted from the upper face surface 38 of the corrugated web 11 progressing in an upstream direction to provide a selectively adjustable partial holddown position.

Figure 5:
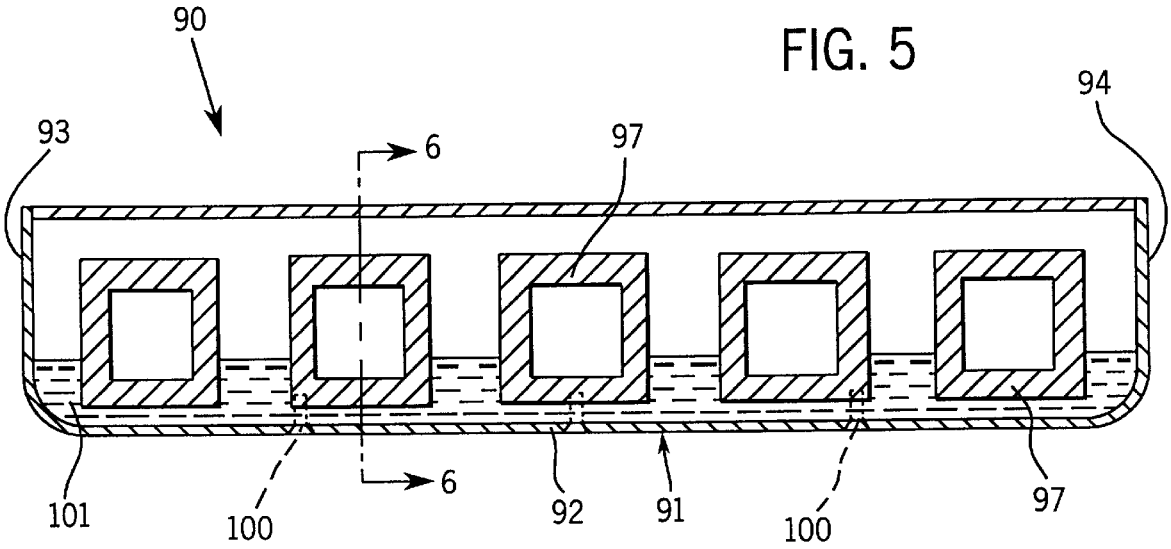
FIG. 5 is a longitudinal vertical section through another embodiment of a heating module.
Figure 6:
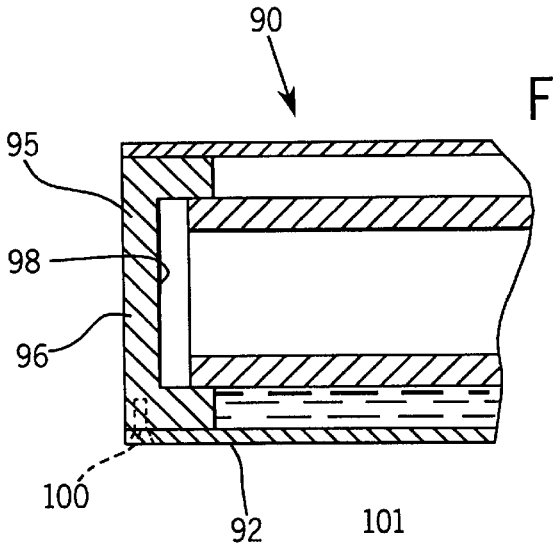
FIG. 6 is a sectional detail taken on line 6—6 of FIG. 5.

Another embodiment of a top heating module 90 is shown in FIGS. 5 and 6. The module 90 includes an enclosing bottom wall 92 which is made of a thin flexible sheet material, such as the stainless steel sheet described with respect to the preceding embodiments. Preferably, the thin metal sheet 91 is formed into a U-shape when viewed in the longitudinal section of FIG. 5 such that the sheet includes integral front and rear walls 93 and 94, respectively. The module may be enclosed laterally by a pair of side walls similar to side walls 54 of the embodiment shown in FIG. 2. In such an embodiment, a serpentine arrangement of steam heating tubes may be utilized as previously described. Alternately, and as shown in FIG. 6, the enclosing side walls 95 may each comprise an integral header 96 providing common connections between the ends of the heating tubes 97, the end most ones of which may be provided with steam supply and condensate discharge connections similar to connections 46 and 50, as shown in the FIG. 2 embodiment. Thus, a simplified header 96 includes an elongated slot 98 by which the steam heating fluid may be distributed to the heating tubes 97 in a conventional manner. The thin flexible sheet 91 may be secured to the headers 96 with flat head screws 100 or other suitable fastening means.

In this embodiment, the heat transfer fluid preferably comprises a very low melting temperature metal alloy material. Such material may be a low melting point solid previously described, such as one including substantially equal parts lead, tin and bismuth with a melting point of about 258° F. Preferably, however, a similar low melting point alloy material includes a high bismuth content, such as 52.5%, with 15.5% tin and 32% lead, and having a melting point of 203° F. The low melting point heat transfer material is placed in a relatively thin layer in the bottom of the module overlying the bottom wall 92. The layer may be as thin as 5/16th inch (8 mm). The heating tubes 97 are preferably spaced quite closely above the bottom wall 92 leaving a space of approximately 1/8th inch (3 mm). Because of the high density of the fluidizable heat transfer alloy, the thin layer will still provide a substantial hydrostatic holddown force to the web when the module 90 is placed in contact therewith. Also, the low temperature characteristics of the high bismuth content heat transfer fluid allows the module joints, such as between the headers 96 and the metal sheet 91, to be sealed with a conventional silicone rubber sealant, such as one having a temperature stability above 380° F. Such silicone rubber sealants, though not adequately compatible with heated oil heat transfer fluids, are fully compatible with the low melting temperature bismuth/lead/tin alloy.

The heating and holddown module 90 of this embodiment may utilize a mounting member 62 of the type described with respect to the preceding embodiments to connect the same to conventional holddown strips. Similarly, an upstream support 36 of the type previously described may be utilized to mount the heating module and to move it vertically into and out of contact with the web.

The thin flexible sheet 91, comprising the bottom and front and rear walls of the module, is preferably constructed to completely span the web in the cross machine direction and to extend slightly beyond the lateral edges thereof. In this manner, the heated module with the high density heat transfer fluid provides a web conforming holddown force that provides uniform contact with the web over its full width while at the same time providing heat to the upper surface.

Although each of the embodiments of the heating and holddown module of the present invention have been described with respect to placing the module onto the upper surface of the web, the modules could as well be placed beneath the traveling web with the conventional hot plates or heating units positioned above the web to contact the upper surface thereof. In such a system, for example, the lower heating module disposed under the running web would be filled with a heat transfer liquid supplemented by a pressurized supply from an external reservoir. In this manner, an upward hydrostatic force could be applied through the flexible contact membrane to the underside of the web, transferring the heat and pressing the web into contact with the stationary heating units now located on the upper web surface.

It is thought that the present invention and its advantages will be understood from the foregoing description. The form of the invention described above being merely a preferred or exemplary embodiment of the invention. It may be apparent that there are changes that can be made without departure from the spirit and scope of the invention and sacrificing all of its material advantages.

I claim:

1. An apparatus for curing the adhesive used for bonding adjacent layers of a web of laminated product as the web travels along the apparatus from an upstream end to a downstream end, the web having a first face surface and a second face surface, the apparatus comprising:

a series of heating units in contact with the first web face surface for applying heat thereto as the web moves along the apparatus, the series of heating units extending in the direction of web travel between the upstream and the downstream end of the apparatus;

a heating module for applying heat to the second face surface of the web simultaneously with the application of heat to the first face surface by the heating units, and for applying pressure to the web to urge the web into intimate contact with the heating units;

a holddown mechanism extending over the web for providing a holddown force on the second face surface of the web as it travels over the heating units, the holddown mechanism having a first end joined to the heating module; and adjustment means for moving the heating module and the holddown mechanism into and out of contact with the web.

2. The apparatus as set forth in claim 1, wherein the heating module is connected to the adjustment means by a hinge mechanism.

3. The apparatus as set forth in claim 1 wherein the heating module comprises a chamber containing a series of heating elements, an outer enclosing membrane providing a flexible module wall and a contact surface for the web, and a heat exchange fluid within the chamber between the heating elements and the membrane wall.

4. The apparatus as set forth in claim 1, wherein the heating module contains a series of interconnected heating tubes.

5. The apparatus as set forth in claim 4, wherein the heating module further comprises a contact plate disposed to contact the second face surface of the web, a heat exchange fluid contacting the series of heating tubes within the module; and the heat exchange fluid conducting heat from the heating tubes through the contact plate to the web.

6. The apparatus as set forth in claim 5 wherein the contact plate is flexible such that when the heating module contacts the second face surface of the web, the contact plate conforms to the second face surface.

7. An apparatus for curing the adhesive used for bonding a laminated web as the web travels in a direction along the apparatus from an upstream end to a downstream end of the apparatus, the web having an upper and a lower face surface, said apparatus comprising:

a series of heating units contacting the lower face surface of the web for applying heat thereto, the series of heating units extending in the direction of web travel between the upstream and the downstream end of the apparatus;

a holddown mechanism extending over the web for providing a holddown force on the upper face surface of the web as it travels over the heating units, the holddown mechanism having an upstream end and a downstream end; and a top heating module for applying heat to the upper face surface of the web simultaneously with the application of heat to the lower face surface by the bottom heating units, the heating module having an upstream end and downstream end, the downstream end of the heating module being attached to the upstream end of the holddown mechanism.

8. The apparatus as set forth in claim 7, further comprising means for moving the top heating module and the holddown mechanism into and out of contact with the web.

9. The apparatus as set forth in claim 8, wherein the top heating module is connected to the moving means by a hinge mechanism.

10. The apparatus as set forth in claim 7, wherein the top heating module contains a series of heating elements.

11. The apparatus as set forth in claim 10 wherein said heating elements comprise heating tubes positioned lateral to the direction of paperboard web travel, the series of heating tubes being interconnected.

12. The apparatus as set forth in claim 11, wherein the top heating module further comprises a heat exchange fluid contained between the series of heating tubes; and a lower contact plate disposed to contact the upper face surface of the paperboard web, the heat exchange fluid conducting heat from the heating tubes through the contact plate to the paperboard web.

13. An apparatus for curing the adhesive used for bonding a laminated web as the web travels in a direction along the apparatus from an upstream end to a downstream end of the apparatus, the web having an upper and a lower face surface, said apparatus comprising:

a series of heating units contacting the lower face surface of the web for applying heat thereto, the series of heating units extending in the direction of web travel between the upstream and the downstream end of the apparatus;

a holddown mechanism extending over the web for providing a holddown force on the upper face surface of the web as it travels over the heating units, the holddown mechanism having an upstream and a downstream end, wherein the holddown mechanism comprises a series of flexible parallel strips, each strip having an upstream end and a downstream end; and a top heating module for applying heat to the upper face surface of the web simultaneously with the application of heat to the lower face surface by the bottom heating units, the heating module having an upstream and downstream end, the downstream end of the heating module being adjacent to the upstream end of the holddown mechanism.

14. The apparatus as set forth in claim 13, wherein the series of flexible parallel strips are connected to the downstream end of the top heating module.

* * * * *